US009302472B1

(12) United States Patent
Mantell et al.

(10) Patent No.: US 9,302,472 B1
(45) Date of Patent: Apr. 5, 2016

(54) PRINTHEAD CONFIGURED TO REFILL NOZZLE AREAS WITH HIGH VISCOSITY MATERIALS

(71) Applicant: Xerox Corporation, Norwalk, CT (US)

(72) Inventors: David A. Mantell, Rochester, NY (US); Peter J. Nystrom, Webster, NY (US); Peter Gulvin, Webster, NY (US); Andrew W. Hays, Fairport, NY (US); Jun Ma, Penfield, NY (US); Gary D. Redding, Victor, NY (US)

(73) Assignee: Xerox Corporation, Nowalk, CT (US)

( * ) Notice: Subject to any disclaimer, the term of this patent is extended or adjusted under 35 U.S.C. 154(b) by 0 days.

(21) Appl. No.: 14/743,064

(22) Filed: Jun. 18, 2015

(51) Int. Cl.
*B41J 29/38* (2006.01)
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/04581; B41J 2/04588; B41J 2/04541; B41J 2/04593; B41J 2/0458
USPC ..... 347/10
See application file for complete search history.

(56) References Cited

U.S. PATENT DOCUMENTS

| | | | | |
|---|---|---|---|---|
| 5,463,416 | A | 10/1995 | Paton et al. | |
| 6,361,154 | B1 * | 3/2002 | Watanabe | B41J 2/14233 347/70 |
| 7,549,731 | B2 | 6/2009 | Silverbrook | |
| 7,758,161 | B2 | 7/2010 | Silverbrook et al. | |
| 8,353,577 | B2 | 1/2013 | McAvoy et al. | |
| 8,506,052 | B2 | 8/2013 | McAvoy et al. | |
| 8,556,373 | B2 | 10/2013 | Buestgens et al. | |
| 2010/0073426 | A1 * | 3/2010 | Silverbrook | B41J 2/14427 347/44 |
| 2015/0140058 | A1 * | 5/2015 | Tumey | A61L 27/56 424/423 |

* cited by examiner

*Primary Examiner* — Manish S Shah
*Assistant Examiner* — Yaovi Ameh
(74) *Attorney, Agent, or Firm* — Maginot Moore & Beck LLP

(57) ABSTRACT

A printer includes a printhead configured to eject high viscosity material and refill a manifold in the printhead with high viscosity material. The printhead includes a layer having an opening to form a reservoir to hold a volume of a high viscosity material and at least one member positioned within the receptacle formed by the opening in the layer. The at least one member has an electroactive element mounted to the member, and an electrical signal generator is electrically connected to the electroactive element. A controller operates the electrical signal generator to activate selectively the electroactive element with a first electrical signal to move the at least one member and thin the high viscosity material adjacent the at least one member to enable the thinned material to move away from the at least one member.

12 Claims, 5 Drawing Sheets

PRINTHEAD CONFIGURED TO REFILL NOZZLE AREAS WITH HIGH VISCOSITY MATERIALS

TECHNICAL FIELD

The device disclosed in this document relates to printheads that eject high viscosity materials and, more particularly, to printers that produce three-dimensional objects with such materials.

BACKGROUND

Digital three-dimensional manufacturing, also known as digital additive manufacturing, is a process of making a three-dimensional solid object of virtually any shape from a digital model. Three-dimensional printing is an additive process in which one or more printheads eject successive layers of material on a substrate in different shapes. The substrate is typically supported on a platform that can be moved three dimensionally by operation of actuators operatively connected to the platform. Additionally or alternatively, one or more actuators are operatively connected to the printhead or printheads for controlled movement of the printhead or printheads to produce the layers that form the object. Three-dimensional printing is distinguishable from traditional object-forming techniques, which mostly rely on the removal of material from a work piece by a subtractive process, such as cutting or drilling.

In some three-dimensional object printers, one or more printheads having an array of nozzles are used to eject material that forms part of an object, usually called build material, and to eject material that forms support structures to enable object formation, usually called support material. Most multi-nozzle printheads contain cavities that are filled with the type of material to be ejected by the printhead. These cavities are pressurized to eject drops of material, but they can only print materials having a very limited range of viscosities. Typically, these materials have a viscosity in the 5-20 cP range. Some materials considered ideal for manufacturing objects have viscosities that are greater than those of materials that can be used in currently known printheads.

To overcome the limitations associated with high viscosity materials, single nozzle printheads have been used to eject materials to form objects. These single nozzle printheads are too large to be manufactured as arrays. Consequently, the productivity of the objects that can be produced by these printheads is limited. Printheads capable of enabling higher viscosity fluids to flow through the channels in a printhead and be ejected from the printheads would be advantageous.

SUMMARY

A printhead is configured to facilitate the thinning of higher viscosity fluids so the thinned fluids flow through the printhead. The printhead includes a layer having an opening to form a reservoir to hold a volume of a high viscosity material, at least one member positioned within the reservoir formed by the opening in the layer, at least one electroactive element that is mounted to the at least one member, and an electrical signal generator electrically connected to the at least one electroactive element to enable a controller to operate the electrical signal generator and activate selectively the at least one electroactive element with a first electrical signal to move the at least one member and thin the high viscosity material adjacent the at least one member and enable the thinned material to move away from the at least one member.

A printer incorporates the printhead configured to facilitate the thinning of higher viscosity fluids so the thinned fluids flow through the printhead. The printer includes a platen, a printhead positioned to eject material onto the platen to form an object, the printhead comprising a layer having an opening to form a reservoir to hold a volume of a high viscosity material, at least one member positioned within the reservoir formed by the opening in the layer, at least one electroactive element that is mounted to the at least one member, and an electrical signal generator electrically connected to the at least one electroactive element to enable a controller to operate the electrical signal generator and activate selectively the at least one electroactive element with a first electrical signal to move the at least one member and thin the high viscosity material adjacent the at least one member and enable the thinned material to move away from the at least one member.

BRIEF DESCRIPTION OF THE DRAWINGS

The foregoing aspects and other features of a printhead or printer that thins higher viscosity fluids for movement through the printhead are explained in the following description, taken in connection with the accompanying drawings.

DETAILED DESCRIPTION

Figure 1:
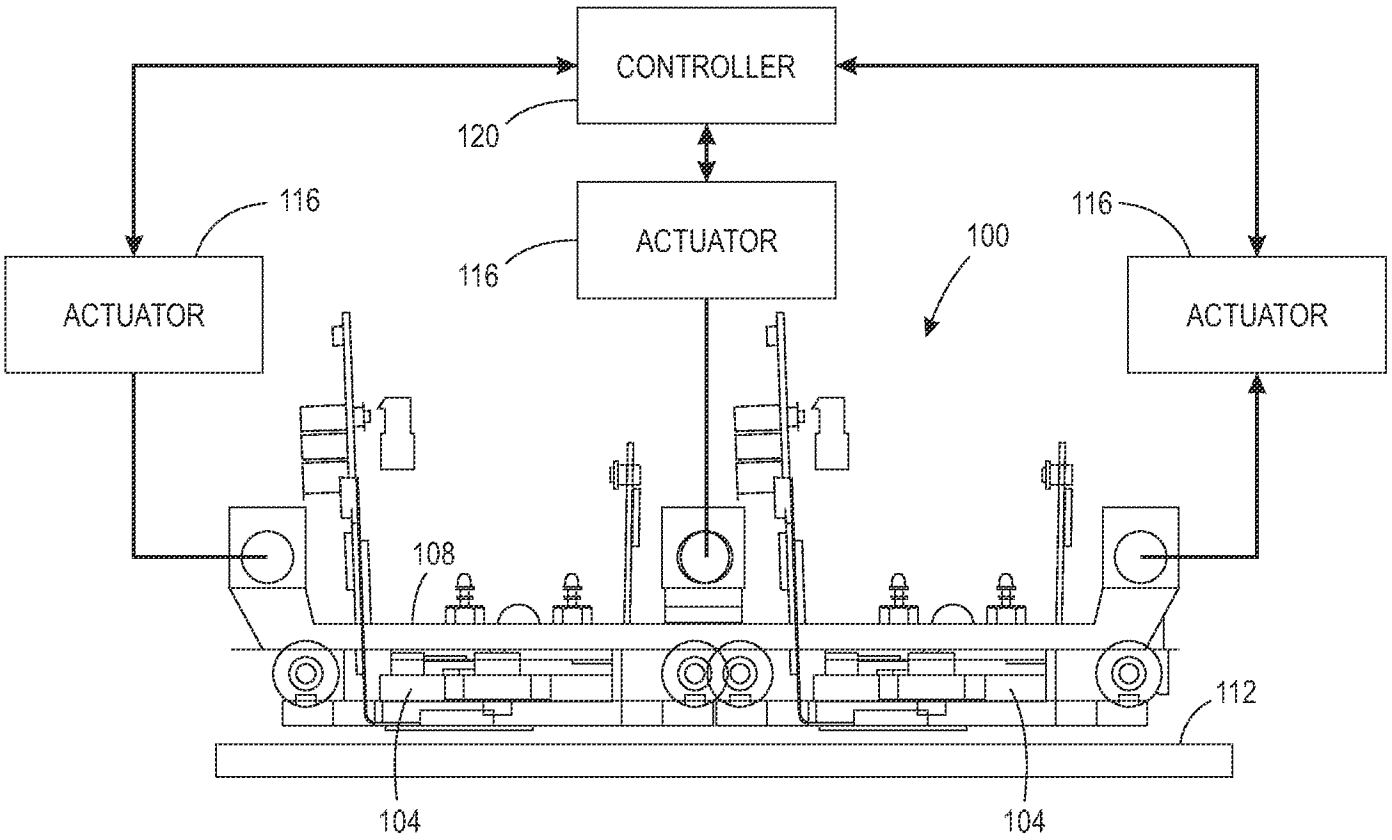
FIG. 1 is block diagram of a pair of printheads and platen configuration in a three-dimensional object printer.

For a general understanding of the environment for the printhead and printer disclosed herein as well as the details for the printhead and printer, reference is made to the drawings. In the drawings, like reference numerals designate like elements.

FIG. 1 shows a configuration of printheads, controller and a platen in a printer 100, which produces a three-dimensional object or part on a platen 112. The printer 100 includes a support platen 112 over which two printheads 104 are carried by a frame 108. While the figure shows two printheads, a single printhead or more than two printheads can be used to configure a printer for forming three-dimensional objects. One of the printheads 104 can be operatively connected to a supply of building material and the other one operatively connected to a supply of support material. The frame 108 to which the two printheads 104 are mounted is operatively connected to actuators 116, which are operatively connected to a controller 120. The controller is configured with electronic components and programmed instructions stored in a memory operatively connected to the controller to operate the actuators and move the frame in an X-Y plane and a Z plane relative to the stationary platen. The X-Y plane is parallel to the surface of the platen 112 opposite the printheads 104 and the Z plane is perpendicular to the surface of the platen. Alternatively, the platen 112 can be operatively connected to the actuators 116 and the controller 120 to enable the controller to move the platen in the X-Y plane and the Z plane relative to the stationary frame 108 and printheads 104. In yet another alternative embodiment, the frame 108 and the platen 112 can be operatively connected to different actuators to enable the controller 120 to move both the platen and the frame in the X-Y plane and the Z plane.

While the platen 112 of FIG. 1 is shown as a planar member, other embodiments of three-dimensional object printers include platens that are circular discs, an inner wall of a rotating cylinder or drum, or a rotating cone. The movement of the platen and the printhead(s) in these printers can be described with polar coordinates. The internal structure of the printheads discussed below that enable higher viscosity materials to be used in the printheads 104 can be used with any of the alternative platens.

Figure 5:
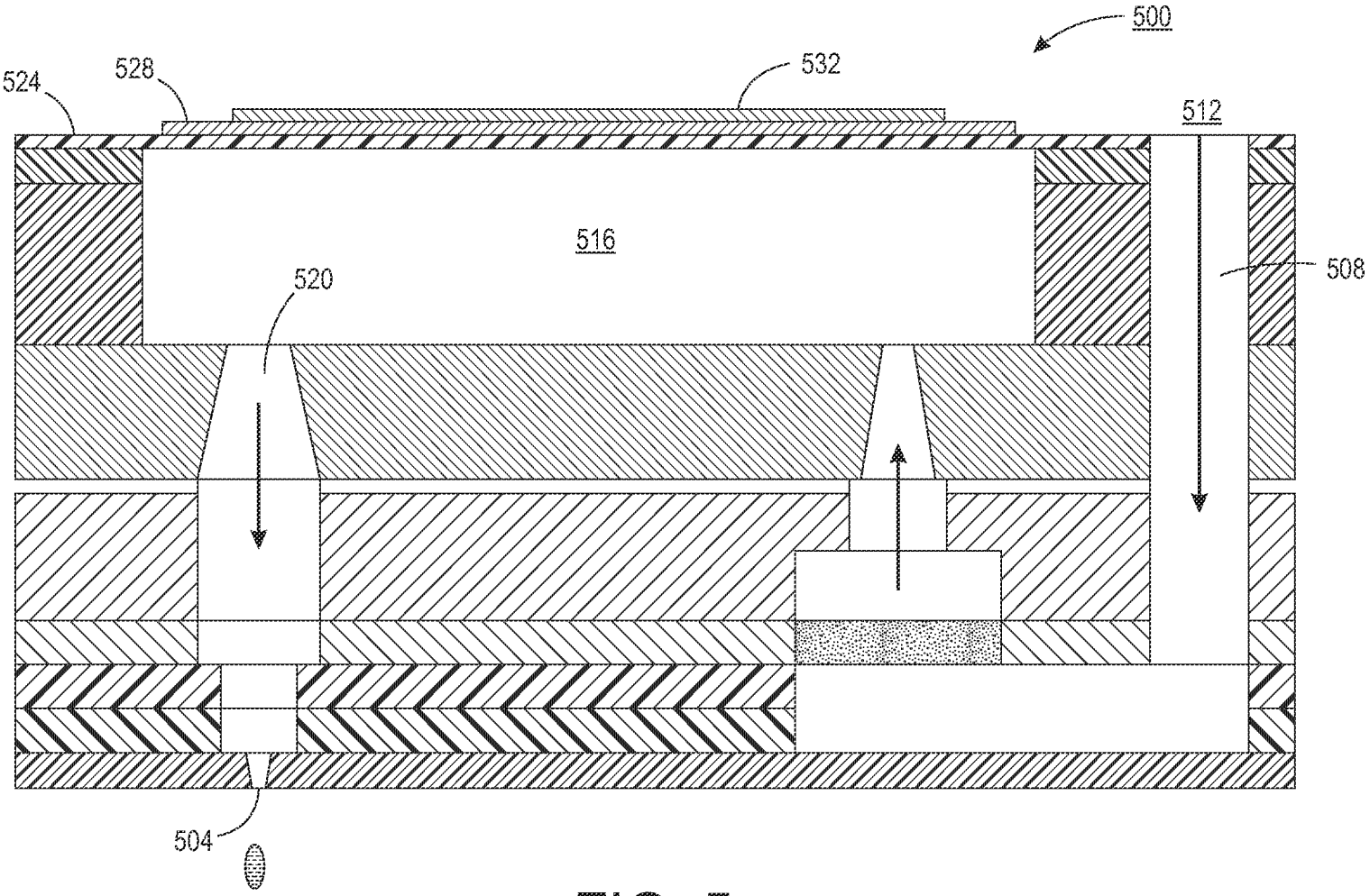
FIG. 5 PRIOR ART
FIG. 5 is a cross-sectional view of a prior art printhead that depicts the fluid paths that impede the travel of high viscosity fluids in the printhead.

A cross-sectional view of a portion of prior art printhead is provided in FIG. 5. The inkjet 500 associated with a single nozzle 504 includes a feed channel 508 that makes a U-shaped turn to connect a manifold 512 with a pressure chamber 516, which, in turn, is connected to an outlet 520 that communicates with the nozzle 504. Adjacent one surface of the pressure chamber 516 is a flexible member 524, which commonly known as a diaphragm. A piezoelectric actuator 528 is bonded to the diaphragm 524 and an electrode 532 is bonded to the actuator 528. The electrode 532 is electrically connected by an electrical conductor to a firing signal generator (not shown). A firing signal delivered by the conductor to the electrode 532 activates the actuator 528, which bends and distends the diaphragm 524 into the pressure chamber 516. The distention of the diaphragm propels ink from the pressure chamber 516 through the outlet 520 and out through the nozzle 504. The actuator 528 and the diaphragm 524 return to their original position once the firing signal has dissipated. The reduced volume of ink in the pressure chamber 516 generates a suction that pulls ink from the manifold 512 through the feed channel 508 into the pressure chamber 516. In this manner, ink is replenished within the pressure chamber 516.

The above-described operation of an ink ejection and replenishment cycle can be performed with fluids having a viscosity of 20 cP or less. For fluids having a viscosity greater than 20 cP, the operation of the actuator 528 and the diaphragm 524 is inadequate to propel a drop from the nozzle and the fluid does not easily flow along the U-shaped path of the feed channel 508. Thus, different structures are required in printheads to promote the flow of the higher viscosity fluids through the printhead. As used in this document, "high viscosity material" refers to a material having a viscosity that is greater than 20 cP at the operating temperature of the printhead and that possesses the property called shear thinning. "Shear thinning" means that the viscosity of the material decreases in response to shear stress. A class of materials that exhibits shear thinning is pseudoplastics. The thinning of pseudoplastics is time independent. Additionally, many materials that can be used in object manufacturing processes are thixotropic, which indicates the thinning of the material is time dependent. That is, as the time to which the material is subjected to shear stress is increased, the viscosity of the material continues to decrease.

Figure 2:
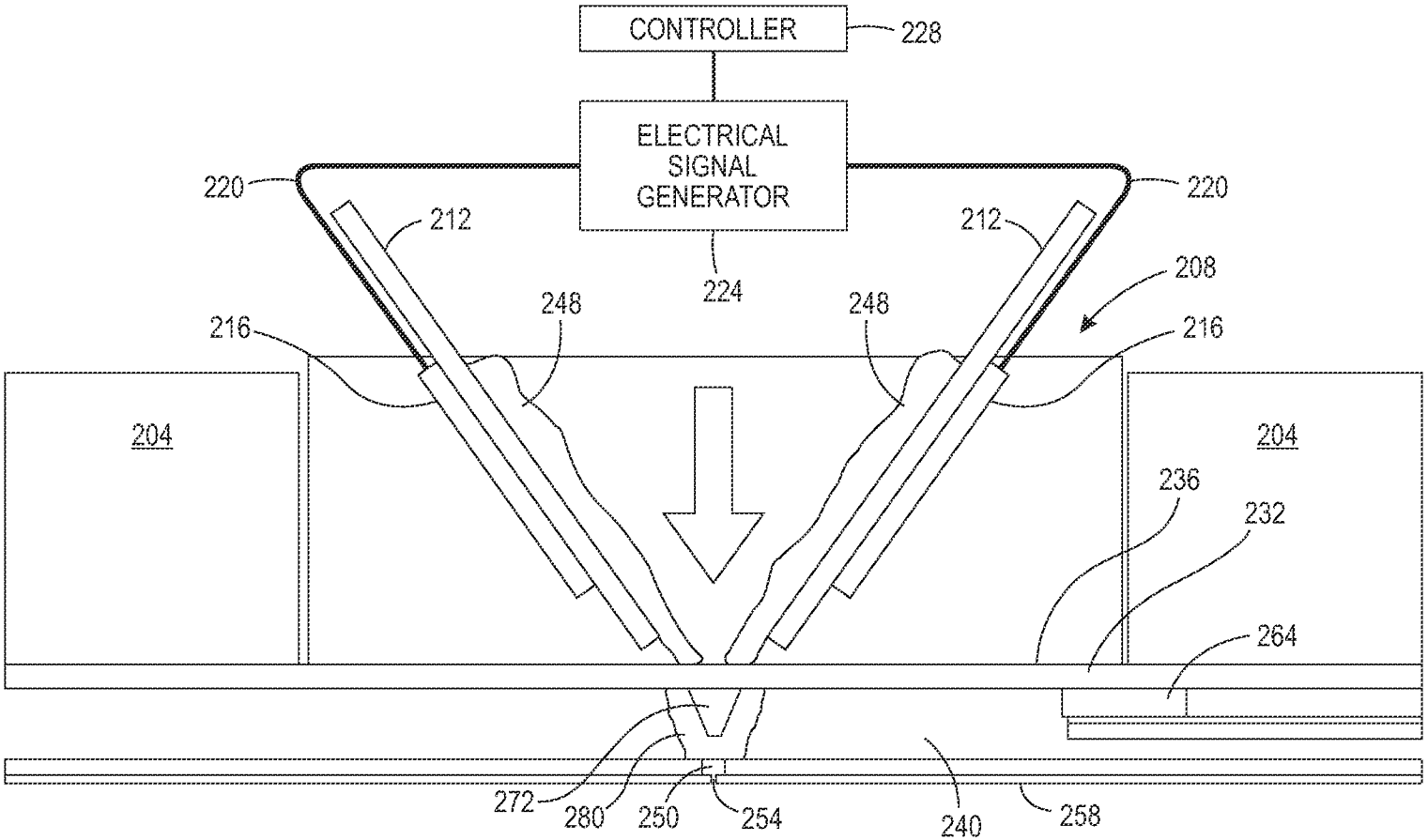
FIG. 2 is a cross-sectional view of an ejector in the printhead shown in of FIG. 1.

A fluid ejector configured for use with high viscosity fluids is shown in FIG. 2. A layer 204 is configured with an opening 208 to form a reservoir, which acts as a manifold for chamber 240 that holds fluid for ejection through a plurality of nozzles 250 in layer 258. Within the manifold is a pair of feed plates 212, which in the depicted embodiment are members positioned at an angle with respect to a bottom of the manifold and to each other. While the plates 212 are depicted as planar members in the figure, the plates can also be curved or have other non-linear shapes. In one embodiment, the plates 212 are metal substrates. In the illustrated embodiment, the plates 212 are oriented at a right angle with respect to one another, although other angles can be used. On one side of each feed plate 212 is a transducer 216. Each transducer 216 is an electroactive element, which means, as used in this document, any material that responds to an electrical signal by changing its length in at least one dimension. An electroactive element can be piezoelectric, capacitive, thermal, electrostatic, or the like. Each transducer includes an electrical conductor 220 that electrically connects a transducer to an electrical signal generator 224 that is operated by a controller 228. The sides of the opening 208 in the layer 204 and the planar member 232 that forms the floor 236 of the manifold hold a volume of a high viscosity fluid. In response to the controller 228 operating the electrical signal generator 224 to generate a high frequency signal, the transducers 216 vibrate and cause the plates 212 to vibrate as well. The vibration of the plates imparts sufficient energy to the high viscosity fluid to thin the fluid in the regions 248 and enable the thinned fluid to flow more easily than the high viscosity fluid. A passage 308 in the planar member 232, which can be in the form of a slot as shown in FIG. 3, enables the thinned fluid to flow through the passage 308 in the member 232 and enter the pressure chamber 240 on the other side of the planar member 232.

With continued reference to FIG. 2, the pressure chamber 240 fluidly communicates with an outlet 250 and a nozzle 254 in nozzle plate 258. An electroactive element 264 is mounted to member 232. A protrusion 272 is also mounted to the member 232 at a position opposite the outlet 250 and nozzle 254. The protrusion 272 is depicted with a trapezoidal shape, but other shapes effective for thinning high viscosity fluid can be used. The electroactive element 264 is electrically connected by an electrical conductor (not shown) to the electrical signal generator 224 to enable an electrical signal to be applied to the element 264, which bends the element 264 and the member 232 in response to the signal. In some embodiments, the member 232 has a bending modulus that is different than the bending modulus of the electroactive element 264 so the junction between the electroactive element and the member 232 acts as a bimorph. The member 232 and the protrusion 272 move in response to the bending of the electroactive element 264. A controller, such as controller 228, is operatively connected to the signal generator 224 to activate the electroactive element 264 selectively. In response, the member 232 and protrusion 272 move relative to the high viscosity material in the pressure chamber 240 to produce shear stress in the material in the region 280 adjacent the protrusion. This shear stress decreases the viscosity of the material to levels that enable the material to move through the outlet 250 and be ejected from the nozzle 254.

In one embodiment, the electroactive element 264 is a piezoelectric material and the member 232 is a substrate of metal. In response to the activation of the electroactive element 264, portion of the member 232 extending beyond the element 264 to the protrusion 272 acts as a cantilever and moves the protrusion 272 of the member 232 up and down. The up and down movement of the protrusion 272 operates as a hammer in the high viscosity fluid in pressure chamber 240. This hammer action imparts shear stress to the high viscosity fluid in region 280 adjacent to the protrusion 272 and decreases the viscosity of that fluid in that region. This decrease in viscosity and the energy provided by the protrusion 272 ejects a portion of the thinned high viscosity material through the nozzle 254. The thinning of the high viscosity fluid in the vicinity of the electroactive element 264 and member 232 along with the thinning of the high viscosity fluid in the regions 248 adjacent to the plates 212 enables the thinned material at the plates 212 to migrate through the passage 308 and into the volume adjacent the protrusion 272. This movement of the thinned fluid replenishes the amount of thinned material in the pressure chamber 240. In effect, the thinning of the material in regions 248 and 280 form a channel of thinned fluid that not only enables the ejection of material from the printhead, but the replenishment of material in the printhead as well.

Figure 3:
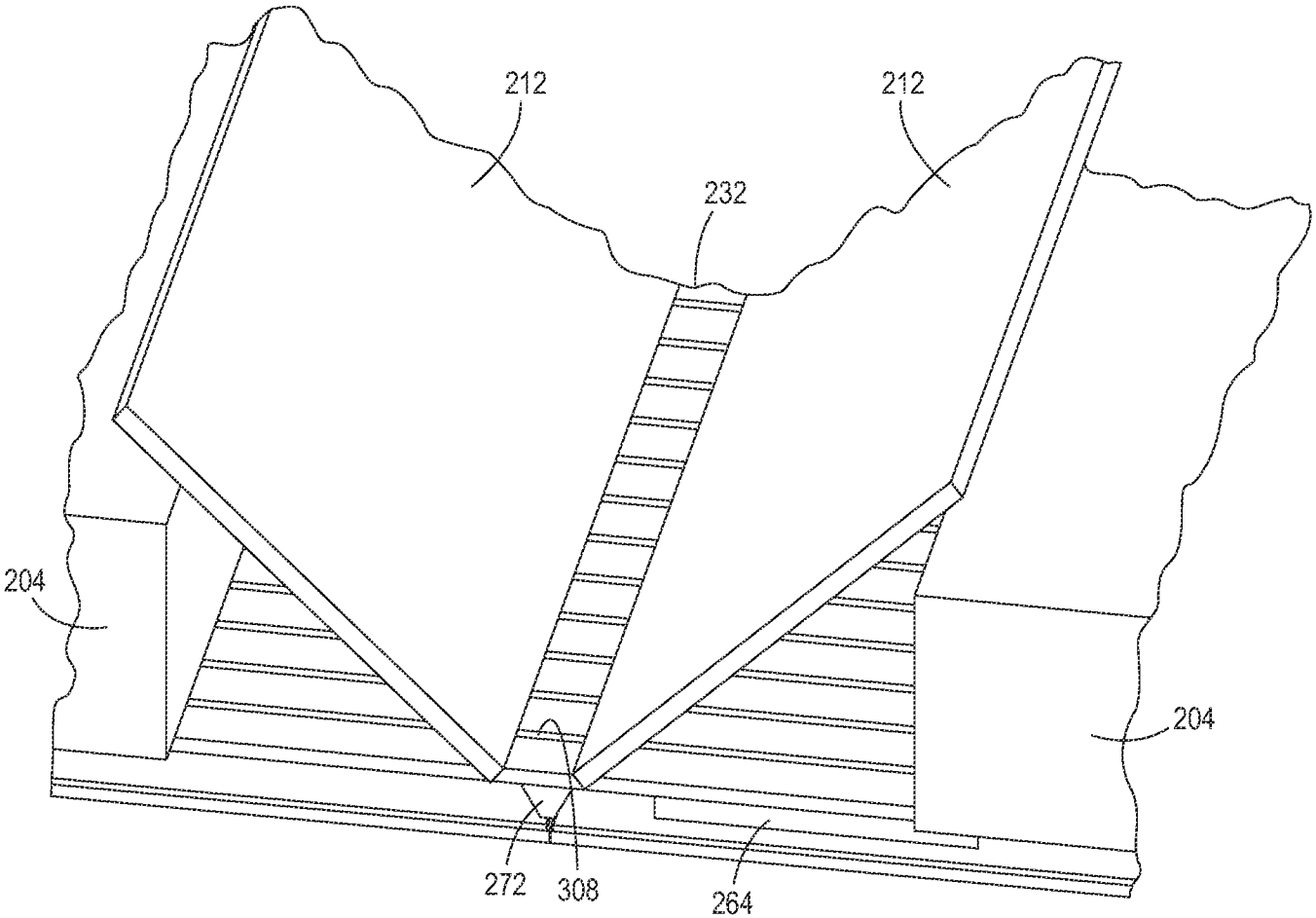
FIG. 3 is a perspective view of one embodiment of a pair of plates for the ejector in the printhead shown in FIG. 2.

FIG. 3 provides a perspective view of the structure shown in FIG. 2. The plates 212 are positioned at an angle to one another and one end of each plate is positioned adjacent the member 232. Member 232 forms a floor for the manifold formed by the opening in the layer 204. A portion of the layer 204 that would be present in the foreground of FIG. 3 has been removed to enable the relationship of the plates 212 and the passages 308 to be viewed. The passages 308 in the member 232 are offset from the protrusions 272 on the opposite side of member 232 to enable the thinned fluid to flow into the pressure chamber 240 at a position proximate the protrusion. Electroactive element 264 is shown mounted to the opposite side of member 232.

Figure 4:
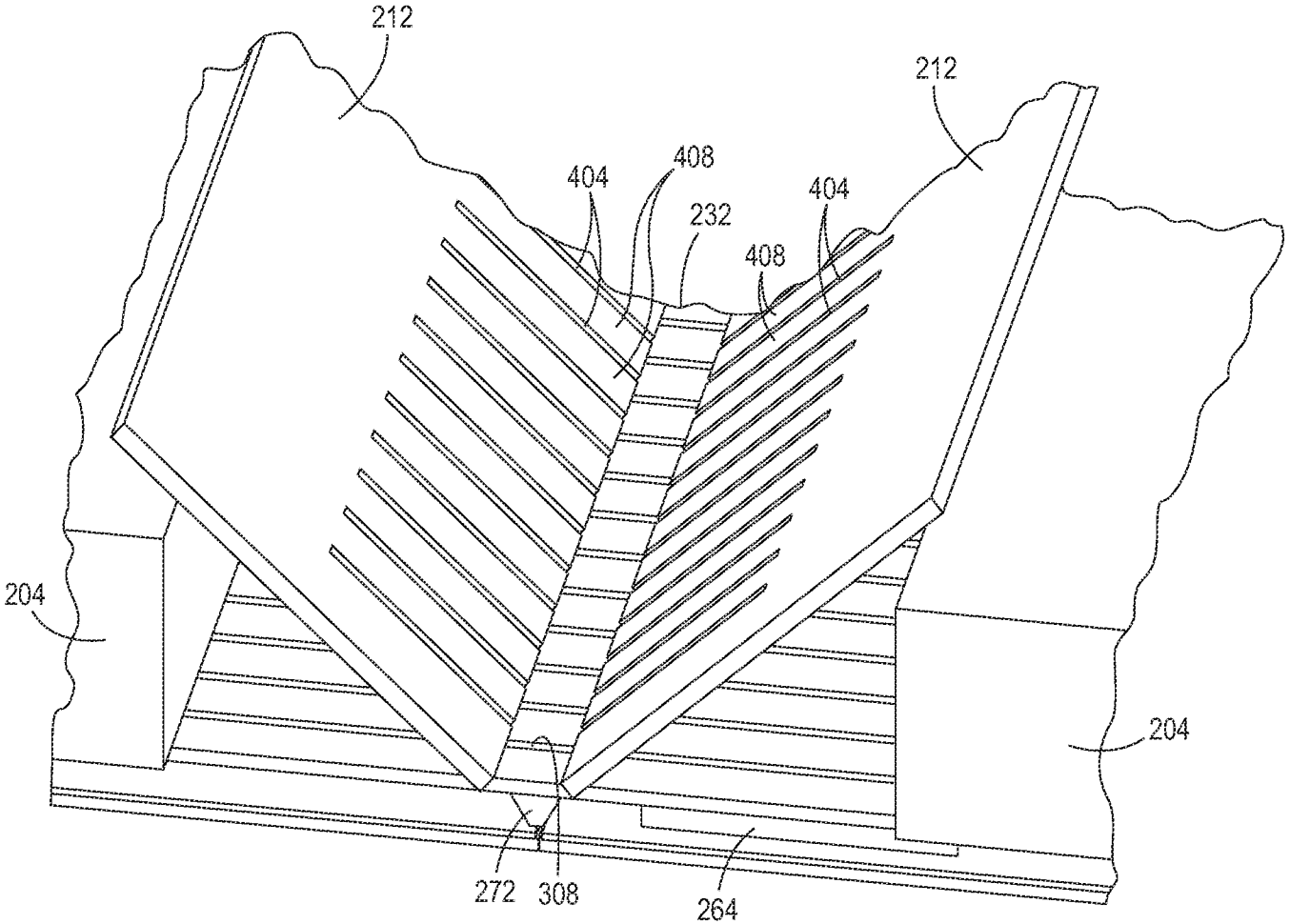
FIG. 4 is a perspective view of an alternative embodiment of a pair of plates for the ejector in the printhead shown in FIG. 2.

FIG. 4 is a perspective view of an alternative embodiment of the manifold and plates 212 shown in FIG. 3. Using the same reference numbers for the structures, the embodiment of FIG. 4 is the same view as the one shown in FIG. 3 except that the plates 212 include slits 404. The slits 404 form flexible members 408 in the plate 212. Electroactive elements are mounted to the underside of the flexible members 408 in the plate 212 as shown by electroactive elements 216 in FIG. 2. Again, as shown in FIG. 2, an electrical conductor connects an electrical signal generator 224 to the electroactive elements so the controller 228 can operate the signal generator 224 and selectively activate the electroactive elements 216 mounted to the opposite side of the flexible members 408. The activation of the electroactive elements vibrates the flexible members 404 in the high viscosity fluid with larger local amplitudes to produce more efficient thinning of the high viscosity fluid in the regions 248 than the amplitude of the plate 212 produced in the embodiment of FIG. 3.

The material ejectors described above with reference to FIG. 2, FIG. 3 and FIG. 4 can easily be fabricated using techniques similar to those used in production inkjet printheads. That is, they can be formed with nickel electroformed parts, which are laminated with photo-chemically etched stainless parts or laser cut polymer films. Additionally, many of these ejectors can also be constructed using MEMS techniques with lithography, deposition, and etching of silicon, glass and photopolymers, such as SU8 or BCB. Additionally, while the above-described embodiments are depicted as being located in manifolds that feed pressure chambers, structures similar to the plates mounted to electroactive elements can be used in other fluid passageways to thin high viscosity fluid and facilitate movement of the fluids throughout the ejector heads.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printhead comprising:

a layer having an opening to form a reservoir to hold a volume of a high viscosity material;

a plurality of members positioned at an angle to one another within the reservoir formed by the opening in the layer, each member in the plurality of members having at least one electroactive element mounted to the member;

a member mounted to the layer having the opening to form a floor of the reservoir, the member mounted to the layer having a plurality of passages in the member, each passage extending between adjacent members in the plurality of members and the passages are fluidly connected to a chamber on a side of the member mounted to the layer that is opposite the reservoir;

a plurality of protrusions mounted to the member forming the floor of the reservoir on the side of the member on which the chamber is positioned;

a plurality of electroactive elements being mounted to the member forming the floor of the reservoir on the side of the member on which the chamber is positioned, each electroactive element being positioned to move a corresponding protrusion in the plurality of protrusions in response to an electrical signal;

a plurality of nozzles, each nozzle in the plurality of nozzles being positioned opposite a corresponding protrusion; and an electrical signal generator electrically connected to each electroactive element mounted to each member in the plurality of members to enable a controller to operate the electrical signal generator and activate selectively each electroactive element with a first electrical signal to move the member to which the electroactive element is mounted and thin the high viscosity material adjacent the member to which the activated electroactive element is mounted and to enable the thinned material to move away from the member to which the activated electroactive element is mounted; and the electrical signal generator being electrically connected to each electroactive element in the plurality of electroactive elements mounted to the member forming the floor of the reservoir to enable the controller to operate the electrical signal generator and activate selectively each electroactive element in the plurality of electroactive elements mounted to the member forming the floor of the reservoir with a second electrical signal to move a portion of the member forming the floor of the reservoir between the electroactive element receiving the second electrical signal and the corresponding protrusion to thin the high viscosity material adjacent the corresponding protrusion and enable the thinned material to be ejected through the corresponding nozzle.

2. The printhead of claim 1 wherein each electroactive element is piezoelectric.

3. The printhead of claim 1 wherein each electroactive element is thermal.

4. The printhead of claim 1 wherein each electroactive element is electrostatic.

5. The printhead of claim 1 wherein each electroactive element is capacitive.

6. The printhead of claim 1, each protrusion in the plurality of protrusions having a trapezoidal shape.

7. A printer comprising:

a platen;

a printhead positioned to eject material onto the platen to form an object, the printhead comprising:

a layer having an opening to form a reservoir to hold a volume of a high viscosity material;

a plurality of members positioned at an angle to one another within the reservoir formed by the opening in the layer, each member in the plurality of members having at least one electroactive element mounted to the member;

a member mounted to the layer having the opening to form a floor of the reservoir, the member mounted to the layer having a plurality of passages in the member, each passage extending between adjacent members in the plurality of members and the passages are fluidly connected to a chamber on a side of the member forming the floor of the reservoir that is opposite the reservoir;

a plurality of protrusions mounted to the member forming the floor of the reservoir on the side of the member on which the chamber is positioned;

a plurality of electroactive elements being mounted to the member forming the floor of the reservoir on the side of the member on which the chamber is positioned, each electroactive element being positioned to move a corresponding protrusion in the plurality of protrusions in response to an electrical signal;

a plurality of nozzles, each nozzle in the plurality of nozzles being positioned opposite a corresponding protrusion; and an electrical signal generator electrically connected to each electroactive element mounted to each member in the plurality of members to enable a controller to operate the electrical signal generator and activate selectively each electroactive element with a first electrical signal to move the member to which the electroactive element is mounted and thin the high viscosity material adjacent the member to which the activated electroactive element is mounted and to enable the thinned material to move away from the member to which the activated electroactive element is mounted; and the electrical signal generator being electrically connected to each electroactive element in the plurality of electroactive elements mounted to the member forming the floor of the reservoir to enable the controller to operate the electrical signal generator and activate selectively each electroactive element in the plurality of electroactive elements mounted to the member forming the floor of the reservoir with a second electrical signal to move a portion of the member forming the floor of the reservoir between the electroactive element receiving the second electrical signal and the corresponding protrusion to thin the high viscosity material adjacent the corresponding protrusion and enable the thinned material to be ejected through the corresponding nozzle.

8. The printhead of claim 7 wherein each electroactive element is piezoelectric.

9. The printhead of claim 7 wherein each electroactive element is thermal.

10. The printhead of claim 7 wherein each electroactive element is electrostatic.

11. The printhead of claim 7 wherein each electroactive element is capacitive.

12. The printhead of claim 7, each protrusion in the plurality of protrusions having a trapezoidal shape.

* * * * *